United States Patent [19]

Muntean et al.

[11] Patent Number: 5,040,727

[45] Date of Patent: Aug. 20, 1991

[54] UNIT FUEL INJECTOR WITH PLUNGER MINOR DIAMETER FLOATING SLEEVE

[75] Inventors: George L. Muntean; Gary L. Gant; C. Edward Morris, Jr., all of Columbus; David Bolis, Nashville; Kevin L. Vogt; David E. Shultz, both of Columbus, all of Ind.

[73] Assignee: Cummins Engine Company, Inc., Columbus, Ind.

[21] Appl. No.: 554,465

[22] Filed: Jul. 19, 1990

[51] Int. Cl.[5] ..... B05B 9/00; F02M 45/00

[52] U.S. Cl. ..... 239/91; 239/88; 239/533.9; 239/124

[58] Field of Search ..... 239/88, 89, 90, 91, 239/92, 95, 533.2, 533.3, 533.4, 533.5, 533.9, 533.12, 124, 125

[56] References Cited

U.S. PATENT DOCUMENTS

| | | | |
|---|---|---|---|
| 2,144,861 | 1/1939 | Truxell, Jr. | 239/88 |
| 2,144,862 | 1/1939 | Truxell, Jr. | 239/88 |
| 2,872,247 | 2/1959 | Shallenberg | 239/89 |
| 3,351,288 | 11/1967 | Perr | 239/533.3 |
| 3,831,846 | 8/1974 | Perr et al. . | |
| 4,280,659 | 7/1981 | Gaal et al. . | |
| 4,441,654 | 4/1984 | Peters | 239/89 |
| 4,471,909 | 9/1984 | Perr | 239/95 |
| 4,601,086 | 7/1986 | Gerlach . | |
| 4,650,121 | 3/1987 | Augustin . | |
| 4,813,600 | 3/1989 | Shultz et al. | 239/88 |
| 4,932,374 | 6/1990 | Klomp et al. | 239/533.12 |

*Primary Examiner*—Andres Kashnikow
*Assistant Examiner*—Christopher G. Trainor
*Attorney, Agent, or Firm*—Sixbey, Friedman, Leedom & Ferguson

[57] ABSTRACT

A unit fuel injector is disclosed to be used in a fuel injection system of an internal combustion engine wherein each unit injector is operated independently from one another and in synchronization with the internal combustion engine. Specifically, the unit injector in accordance with the present invention includes a reciprocating plunger assembly within the unit injector that controls fuel metering as well as fuel injection, and a valve device positioned between a minor diameter plunger section and a cup of the unit injector so as to permit fuel flow in one direction for fuel injection and to restrict flow of gases in the opposite direction. The valve device effectively reduces carbon build-up on the injector surfaces and increases injector longevity while reducing maintenance. Moreover, fuel metering is accurately controlled without substantial carboning flow losses.

20 Claims, 2 Drawing Sheets

UNIT FUEL INJECTOR WITH PLUNGER MINOR DIAMETER FLOATING SLEEVE

TECHNICAL FIELD

The present invention relates to unit fuel injectors of the type having a reciprocating injection plunger that is operatively actuated from an engine camshaft, and in particular to such a unit injector including a valve device for restricting backflow of combustion gases into the unit injector.

BACKGROUND OF THE INVENTION

Heretofore, various type fuel injectors and fuel injection systems have been known in the prior art which are applicable to internal combustion engines. Of the many types of fuel injection systems, the present invention is directed to unit fuel injectors, wherein a unit fuel injector is associated with each cylinder of an internal combustion engine and each unit injector includes its own drive train to inject fuel into each cylinder on a cyclic basis. Normally, the drive train of each unit injector is driven from a rotary mounted camshaft operatively driven from the engine crankshaft for synchronously controlling each unit injector independently and in accordance with the engine firing order.

Of the known unit injectors of such fuel injection systems, there are two basic types of unit injectors which are characterized according to how the fuel is metered and injected. A first type of which the present invention is a modification is known as an "open nozzle" fuel injector because fuel is metered to a metering chamber within the unit injector while the metering chamber is open to the engine cylinder by way of injection orifices. Moreover, open nozzle injectors typically include a plunger assembly with a tip portion that seats around the injection orifices after injection.

In contrast to the open nozzle type fuel injector, there are also unit fuel injectors classified as "closed nozzle" fuel injectors, wherein fuel is metered to a metering chamber within the unit injector while the metering chamber is closed to the cylinder of an internal combustion engine by a biased valve mechanism that is opened only during injection by the increasing fuel pressure acting on the valve mechanism and overcoming the valve bias. Typically, the valve mechanism is a spring biased needle type valve.

In either case, the unit injector typically includes a plunger element that strikes the metered quantity of fuel to increase the pressure of the metered fuel and force the metered fuel into the cylinder of the internal combustion engine. In the case of a closed nozzle injector, a tip valve mechanism is provided for closing the injection orifices during metering wherein the tip valve is biased toward its closed position to insure that injection will take place only after the fuel pressure is increased sufficiently to open the tip valve mechanism against the bias force.

A known manner of supplying fuel to unit fuel injectors which is applicable to the present invention is a unit injector fuel injection system that relies on pressure and time principles for determining the quantity of fuel metered for each subsequent injection of each injector cycle Moreover, the pressure-time principles allow the metered quantity of fuel to be varied for each cyclic operation of the unit injector as determined by the pressure of the fuel supplied to the metering chamber and the time duration over which such metering takes place.

Examples of unit injectors of the open nozzle type are described in detail in U.S. Pat. Nos. 4,280,659 and 4,601,086 to Gaal et al. and Gerlach, respectively, both of which are owned by the assignee of the present invention. The injectors of Gaal et al. and Gerlach include a plunger assembly with a lower plunger having a major diameter section that is slidable within an axial bore of the injector body and a smaller minor diameter section that extends within a cup of the injector body. The cup provides an extension to the axial bore which is smaller in diameter than the diameter of the axial bore that passes through the remainder of the injector body. During the metering stage of the Gaal et al. and Gerlach injectors, fuel is metered through a supply port into the axial bore at a point above the cup, and the fuel flows around the minor diameter section of the plunger assembly at the tip thereof for metering a specified quantity of fuel into the metering chamber of the cup. A radial gap is provided between the minor diameter section of the plunger assembly and the inner wall of the bore within the cup. This gap facilitates the flow of fuel to the injector tip to be injected. Once the metering stage is completed, the plunger travels inwardly (defined as toward the engine cylinder of an internal combustion engine) so as to cause injection of the fuel from the metering chamber through the injection orifices.

A serious problem that is unique to open nozzle-type unit fuel injectors is the sensitivity of fuel metering to carboning of the unit fuel injector. Injector carboning occurs on all of the surfaces of the minor diameter section of the plunger and the inner surface of the cup. As best understood, the carbon forms as a result of essentially oil, fuel, and the temperature of the gases within the unit injector metering chamber. Moreover, carboning has a greater tendency to occur during certain engine operating conditions wherein little or no fuel is supplied to the metering chamber within an injector cycle. Such conditions include that which is defined as a motoring condition where the engine is being driven from the vehicle drive train. During motoring, the plunger is lifted in accordance with the injector cycle as controlled by the associated camshaft, but little or no fuel is supplied. At the same time, the engine piston is experiencing a compression stroke, which pressurizes the cylinder gases and forces the hot gases back into the unit injector through its nozzle. The lack of fuel in the metering chamber during such a condition allows the gas temperatures inside the metering chamber to become very high.

Additionally, when the plunger tip unseats from the cup, airborne carbon enters the metering chamber from the engine combustion chamber through the injector spray holes. This airborne carbon then deposits on to the surfaces of the plunger and cup. A study of the carbon deposits on the plunger and cup has shown that, in cross section, a first layer of deposits on the surfaces is related to fuel and acts as a kind of adhesive. The outer layer consists of hard black carbon deposits which result mostly from oil. This outermost layer of deposits is responsible for creating this major problem of open nozzle-type unit injectors in that the deposits create injector flow loss which inhibits the flow of fuel into the metering chamber during metering.

During metering, fuel must be able to pass between the minor diameter section of the plunger and the inner wall of the cup so as to flow to the metering chamber at the cup tip. As the carbon deposits increase in thickness, the flow loss also increases. At some point it becomes impossible to obtain a sufficient fuel flow between the plunger minor diameter section and the cup inner wall such that a sufficient volume of metered fuel can be created for injection. At this point, the unit injector cannot function properly.

Thus, in order to deal with the carboning situation, it has become necessary to replace, or at least service, such open nozzle unit fuel injectors after a period of running time, depending on operating conditions. As an alternative, efforts have been concentrated on reducing the formation of carboning as a means of lessening the effect of carboning on injector flow metering. However, once carboning eventually builds up, the injector will inevitably experience some injector flow loss.

For the above reasons, the popularity of closed nozzle fuel injectors has increased; however, the immediate disadvantage associated with closed nozzle fuel injectors is the extra costs that are associated with the production of such substantially more complex unit fuel injectors. Apart from the fact that a closed nozzle unit fuel injector functions on different operational principles than an open nozzle injector, as amplified above, closed nozzle injectors do not experience the same problems of open nozzle injectors enumerated above. Specifically, the valve of the closed nozzle injector does not have to be designed to accommodate precise metering at the nozzle. Furthermore, injector carboning is not as prevalent in closed nozzle unit fuel injectors because the biased nozzle valve effectively closes the interior of the unit injector at the very tip thereof from the engine combustion chamber during motoring or the like conditions.

Other noteworthy U.S. patents with respect to the present invention are U.S. Pat. Nos. 3,831,846 to Perr et al. and 4,650,121 to Augustin. Perr et al. '846 is also owned by the assignee of the present invention and discloses an open nozzle type fuel injector including a tip valve that is movable with respect to the plunger assembly and located within the cup of the injector. The cup includes an enlarged bore, as seen in FIGS. 10-15, having an upper ledge retaining a biasing mechanism within the cup. The device, however, is provided as a means for preventing "secondary injection", and as such is subject to injector carboning the same as the above-described prior art open nozzle injectors. Augustin '121 discloses a closed nozzle unit fuel injector including an insert body 6 press-fit within a cylindrical opening of the injector body which includes swirl channels, wherein the nozzle valve is slidable within the insert body. This injector is not concerned with preventing injector carboning.

Thus, there is a need for a unit fuel injector which prevents injector carboning that occurs during certain engine operating conditions of the type with no fuel or part fuel injection requirements. Moreover, there is a need to provide such a unit fuel injector that is relatively simple to operate and easy to produce along the line of open nozzle unit fuel injectors but which incorporates the advantages of the more complicated closed nozzle injectors with regard to injector carboning. Preferably, such a unit injector will function accurately over the entire useful life of such a unit injector without suffering from excessive flow losses that result from carboning of the plunger and cup surfaces.

SUMMARY OF THE INVENTION

It is an object of the present invention to provide an unit injector that overcomes the shortcomings associated with prior art unit injectors, and which effectively reduces unit injector carboning and thus the effect of injector carboning on fuel metering and injection.

It is another object of the present invention to provide a unit fuel injector which is relatively simple in design and which incorporates the basic elements of a standard open nozzle fuel injector but which includes the functional advantage of closed nozzle unit fuel injectors by reducing the backflow of hot combustion gases that cause injector carboning within the injector. The present invention is basically a hybrid of open nozzle and closed nozzle fuel injector design, wherein fuel is injected directly from a metering chamber by way of the reciprocating plunger assembly while including a valve means for limiting backflow of gases within the unit injector.

It is yet another object of the present invention to provide a unit injector including an injector body with an axial bore, a plunger assembly reciprocably movably disposed within the axial bore, a fuel supply orifice which is opened and closed by movement of the reciprocating plunger assembly, and a valve means located between a minor diameter section of the plunger section and the injector cup which effectively allows fuel metering and injection while substantially restricting or eliminating the backflow of combustion gases into the injector above the injector cup. Such valve means permits fluid (fuel) flow in one direction and restricts fluid (backflow gases) flow in the opposite direction. Specifically, fuel flows from the fuel supply orifice to the injector tip, but gas flow is restricted as blown back into the injector from the engine cylinder so as not to travel above the injector tip. Moreover, the valve means also advantageously is effective for reducing or scraping carbon build-up that may result on the minor diameter section of the plunger assembly. The result is an injector with a longer useful life that can operate under potentially degrading engine operating conditions of the type requiring little or no fuel with reduced carboning and thus reduced maintenance.

It is still yet another object of the present invention to provide a unit fuel injector having a plunger assembly with a minor diameter section that extends within a bore of an injector cup, wherein a floating sleeve is provided as the valve means having a limited axial movement with respect to the injector cup as defined by an undercut means of the cup and through which the minor diameter section can slidably move. The floating sleeve allows fuel flow for metering and injection without hindrance, but restricts gas flow back into the injector above the floating sleeve by forming a seal between the minor diameter section and the injector body when combustion gases are forced into the injector cup. Moreover, the floating sleeve is slidably engaged with the minor diameter section of the plunger assembly so that the floating sleeve scrapes against the minor diameter section to remove any carbon build-up that may form on the minor diameter section.

These and other objects and advantages of the present invention are achieved by a unit injector including an injector body having an axial bore passing therethrough and an injector cup connected at an end of the injector body. A plunger assembly is reciprocably movable within the injector body and cup as driven by an associated drive train synchronously controlled as part of internal combustion engine. The plunger assembly includes a minor diameter section that extends within the cup between an advanced and retracted position and a major diameter section that opens and closes a fuel supply orifice. The cup includes a first bore that is slightly greater in diameter than the plunger minor diameter section which defines a gap sufficient for fuel flow therethrough, and a second bore which is of a diameter larger than the axial bore of the injector body. The result when the cup and the injector body are secured together is an undercut within which a floating sleeve is positioned which is axially movable between an upper annular ledge formed on a lower surface of the injector body and a lower annular ledge within the cup connecting the first and second bores. The floating sleeve is slidably but tightly fit to ride on the external surface of the minor diameter section of the plunger assembly and further includes an upper surface that abuts and seals with the upper annular ledge surface when the floating sleeve is forced upwardly by combustion gases. The floating sleeve additionally includes means at a lower surface thereof for permitting fuel passage around the floating sleeve for injection when the floating sleeve is inwardly (that is, toward the engine cylinder) displaced.

These and further objects, features and advantages of the present invention will become more apparent from the following description when taken in connection with the accompanying drawings which show, for the purposes accordance with the present invention.

DETAILED DESCRIPTION OF THE PREFERRED EMBODIMENTS

Figure 1:
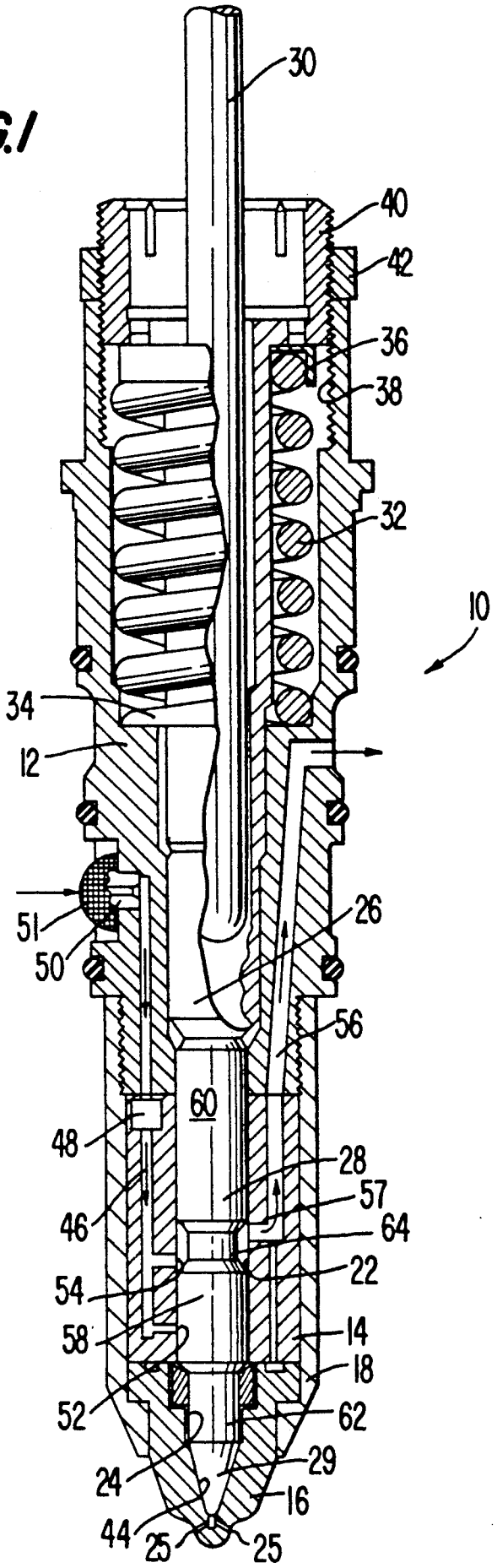
FIG. 1 is a partial, cross-sectional view a unit fuel injector in accordance with the present invention.

Referring now to the drawings, and in particular to FIG. 1, a unit fuel injector 10 is illustrated which is made in accordance with the present invention. Moreover, the specific construction and operation of the present invention and the fuel injector 10 are modifications of the open nozzle unit fuel injector disclosed in U.S. Pat. Nos. 4,280,659 to Gaal et al. and 4,601,086 to Gerlach, both commonly owned by the assignee of the present invention, and both incorporated herein by reference.

The unit injector 10 of the present invention includes an injector body 12, a barrel 14, and a cup 16 positioned in end-to-end relationship. A threaded retainer 18 extends around the barrel 14 and secures the cup 16 and barrel 14 to the injector body 12. An axial bore 20 is provided through the injector body 12, the barrel 14, and most of the way through cup 16. The axial bore 20 is divided into a first portion 22 that comprises the part of the axial bore 20 extending through the injector body 12 and the barrel 14, and a second portion 24 that extends into and terminates within cup 16. Note that the first portion 22 also includes varying diameter sections; however, only the diameter of the lower portion is critically sized for reason that will be apparent below in the further description and operation of the present invention.

A plunger assembly 26 is reciprocably movably disposed within the axial bore 20 and includes a lower plunger 28. The plunger assembly 26 is reciprocably driven by a rod 30 that is operatively associated with an injector drive train (not shown). Such an injector drive train preferably interconnects the unit injector 10 to an engine camshaft of an internal combustion engine to synchronously drive each unit injector of each engine cylinder of the internal combustion engine in accordance with the engine firing order. Of course, the injector camshaft is operatively timed to the engine crankshaft. It is further understood that a unit injector 10 is provided for each cylinder of the internal combustion engine and each unit injector 10 includes an associated drive train for transferring reciprocating movement from the camshaft to each plunger assembly 26.

A return spring 32 is mounted in an enlarged area of the axial bore 20, and the lower end of return spring 32 is positioned on an upper ledge 34 of injector body 12. The upper end of spring 32 engages a washer 36 that is axially fixed in the upward direction to plunger assembly 26. The return spring 32, therefore, urges the plunger assembly upwardly. The upper end of the injector body 12 is internally threaded as indicated at 38 and a top stop 40 is threaded to the injector body 12. A lock nut 42 secures the top stop 40 at a selected position, so as to form a stop which limits the upward movement of washer 36 and thus the plunger assembly 26. The plunger assembly 26 is limited in its downward stroke by the engagement of the tip 29 of the lower plunger 28 against a seat 44 of the cup 16.

A fuel supply passage 46 is provided that passes through the injector body 12 and barrel 14 and includes check valve 48 which permits the flow of fuel in only the supply direction, as indicated by arrows. The upper end of fuel supply passage 46 connects with an inlet regulating plug 50 that is covered by screen 51 for screening impurities before entrance into the injector. The inlet 50 is associated with a common fuel supply rail (not shown) that is provided as known conventionally within the engine head (also not shown) for supplying pressurized fuel to each of the unit injectors 10 of the internal combustion engine. By such a common rail, the fuel pressure can be controlled for determining fuel metering in accordance with pressure-time principles as conventionally known.

The fuel supply passage 46 further includes a supply orifice 52 that opens into the first portion 22 of the axial bore 20. The supply orifice 52 permits fuel to flow to a metering chamber which is defined below the lower plunger 28 and within the axial bore 20 as further described below. At the end of the second bore portion 24 within the cup 16, injection orifices 25 are provided through which metered fuel is injected into an engine cylinder. A second supply orifice 54 is also preferably provided which opens to the first portion 22 of the axial bore 20 at a point above the supply orifice 52. This second supply orifice 54 supplies fuel for injector scavenging as will be described hereinafter in the operation of the present invention.

A drain passage 56 is also provided through the barrel 14 and the injector body 12 which interconnects the axial bore 20 to a drain line (not shown) within the head assembly of the internal combustion engine.

The lower plunger 28 is divided into a first major diameter section 58, a second major diameter section 60, and a minor diameter second 62. The first and second major diameter sections 58 and 60 are separated by a scavenging groove 64 that connects the second supply orifice 54 to the drain passage 56 at drain port 57. The scavenging groove 64 allows fuel to flow through the scavenging groove 64 when the lower plunger 28 is in an advanced position as in FIG. 1, and is used for cooling and lubricating the lower plunger 28 as well as for removing any pollutants that may accumulate within that portion of the unit injector 10.

The major diameter section 58 includes a leading edge 59 which determines the opening and closing of the fuel supply orifice 52 as the lower plunger 28 moves between retracted and advanced positions for controlling fuel metering and injection as further described in the operation of the unit injector below.

The minor diameter section 62 extends within the bore 24 of the cup 16 throughout the movement of the plunger assembly 26 between its advanced and retracted positions.

As best seen in FIGS. 2–5, the bore 24 within cup 16 is divided into a first bore portion 70 and a second bore portion 72. First bore 70 is of a diameter at least just slightly larger than the outer diameter of the minor diameter plunger section 62, and a radial gap 73 is formed therebetween through which metered fuel can pass. The selected diameter of the first bore 70 with respect to the diameter of the minor diameter section 62 and the resultant formation of radial gap 73 is typical in open nozzle unit injectors as known in the prior art. The provision of second bore 72 is, however, unique to the present invention and the second bore is provided with a diameter greater than the diameter of the axial bore 22 located just above cup 16 within barrel 14 This second bore 72 thus forms with an upper annular ledge 74 on the bottom surface of the barrel 14 and undercut within the cup 16. Furthermore, the undercut is defined by a lower annular ledge 76 which connects first bore 70 to second bore 72. The upper and lower ledges 74 and 76 of the undercut define axial limits for a valve means 78 provided within the undercut and surrounding the minor diameter section 62 of lower plunger 28. The valve means 78 comprises a floating sleeve 80 which is slidably engaged with minor diameter section 62 so as to be axially movable thereon. Actually, the floating sleeve 80 moves relative to the cup 16 within the limits set by upper and lower annular ledges 74 and 76, but the minor diameter portion 62 is freely movable with respect to the floating sleeve 80 as moved between its fully advanced and fully retracted positions. The minor diameter section 62 always remains in at least partial contact with an interior surface 82 of the floating sleeve 80 during movement thereof.

Figure 3:
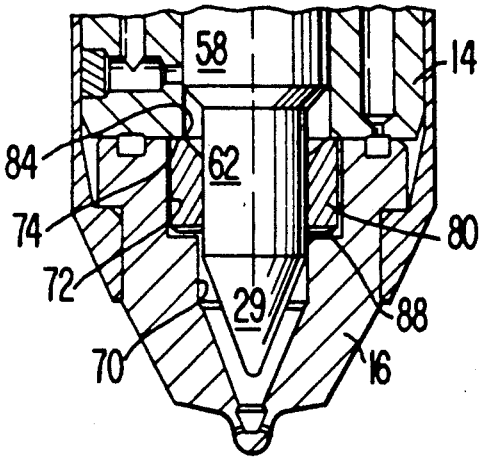
FIG. 3 is an enlarged partial, cross-section similar to FIG. 2 with the plunger assembly partially retracted and the floating sleeve in its uppermost axial position.
Figure 4:
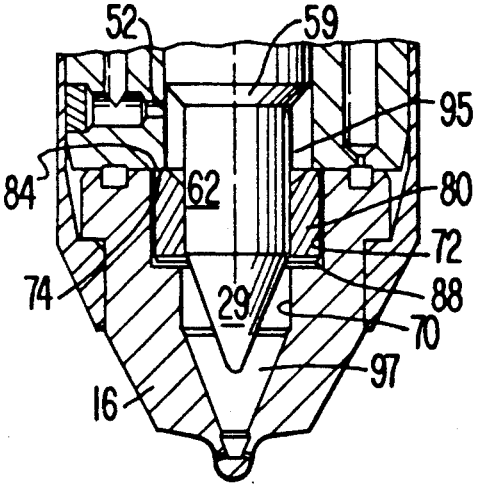
FIG. 4 is an enlarged partial, cross-section similar to FIGS. 2 and 3 with the plunger assembly fully retracted and the floating sleeve in its uppermost position corresponding to a metering stage of the injector cycle.

The floating sleeve 80 further includes an upper annular sealing surface 84 which seats against the upper annular ledge 74 of the barrel 14 when the floating sleeve 80 is in an uppermost axial position, as seen in FIGS. 3 and 4. Moreover, the upper portion of the floating sleeve 80 includes an angled surface 86 which generally corresponds to the slope of the leading edge 59 of the major diameter section 58.

Figure 2:
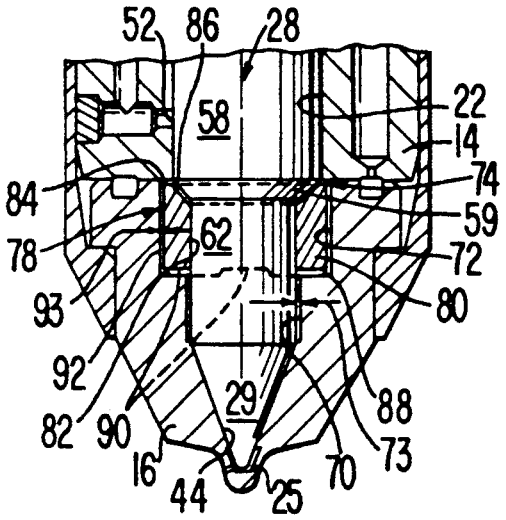
FIG. 2 is an enlarged partial, cross-section of a unit fuel injector in accordance with the present invention, as in FIG. 1, with the plunger assembly in a fully advanced position and the floating sleeve in its lowermost position.
Figure 5:
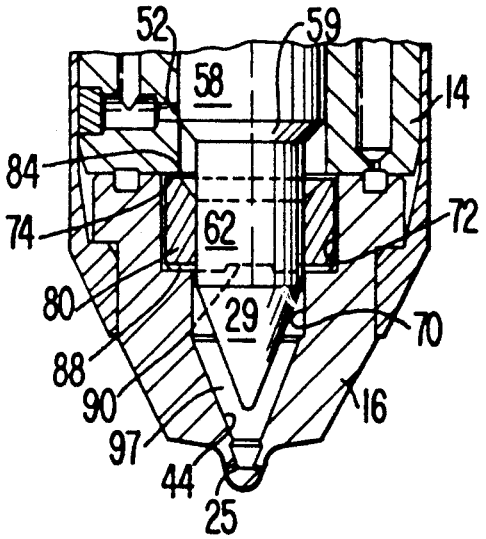
FIG. 5 is an enlarged partial, cross-section similar to FIGS. 2–4 with the plunger assembly partially advanced from the metering stage and the floating sleeve in its lowermost position corresponding to the injection stage of the injector cycle.

At the bottom edge of the floating sleeve 80 a means is provided for allowing passage of fuel flow between the lower edge of floating sleeve 80 and the lower annular edge 76 connecting first bore 70 to second bore 72. This means comprises a profiled lower edge 88 of the floating sleeve 80 provided with a plurality of indents 90 which form passages along with the lower annular ledge 76 when the floating sleeve 80 is in its lowermost position, as seen in FIGS. 2 and 5. As enumerated above, the diameter of the interior surface 82 of the floating sleeve 80 is just slightly larger than the outside diameter of the minor diameter section 62 so as to provide an engagement therebetween, which is advantageously used as a means for scraping the minor diameter section 62 by the upper and lower edges of the interior surface 82 of floating sleeve 80 when the lower plunger 28 is reciprocably moved. The outside diameter of the floating sleeve 80 defining an external surface 92 of floating sleeve 80 is dimensioned to be sufficiently smaller than the diameter of the second bore 72 within cup 16 such that a radial gap 93 is formed through which fuel can adequately pass. The size of the gap is determined on the basis of normal injector gaps utilized within open nozzle fuel injectors.

In operation of the unit injector 10 in accordance with the present invention, reference is made to FIGS. 2–5, beginning with FIG. 2. The lower plunger 28 is shown in its fully advanced position with plunger tip 29 in engagement with cup seat 44. Moreover, the floating sleeve 80 is in its lowermost position with its profiled lower edge 88 in engagement with lower annular ledge 76 of cup 16. This orientation corresponds to the stage in an injector cycle before the start of metering and injection and subsequent to a previous completed cycle. Note that the major diameter section 58 has completely closed fuel supply orifice 52. It is understood that the described positions of the lower plunger 28 and injector stages are preferably controlled by a cam profile of a camshaft as known in prior art open nozzle unit injectors.

Next, just before fuel metering occurs, the lower plunger 28 begins an upward movement (that is, away from the engine cylinder) at which time the plunger tip 29 unseats from seat 44 (see FIG. 3). During this same time, the upward travel of the minor diameter section 62 brings floating sleeve 80 upwardly therealong for the axial distance permitted by upper annular ledge 74 on the bottom surface of barrel 14. Thereafter, the minor diameter section 62 continues upward travel so as to move relative to floating sleeve 80 as floating sleeve 80 is maintained in its uppermost position, as illustrated in FIG. 3. Then, once the leading edge 59 of the major diameter section 58 clears fuel supply orifice 52, fuel passes through the fuel supply orifice 52 under pressure from the pressurized fuel source (not shown) and flows into an upper metering chamber 95 defined between the major diameter plunger leading edge 59, the lower end of axial bore 22 and the upper surfaces 84 and 86 of floating sleeve 80. This corresponds to the metering stage of the injector cycle and is illustrated in FIG. 4. Note that the engagement between the interior surface 82 of the floating sleeve 80 with the plunger minor diameter section 62 effectively prevents fluid flow therebetween.

Subsequently, the lower plunger 28 is driven inwardly (toward the engine cylinder) under the influence of its associated drive train (not shown). The leading edge 59 of major diameter section 58 closes the fuel supply orifice 52 and the metering stage is completed (see FIG. 5). The amount of fuel metered depends on the pressure of fuel supplied through fuel supply orifice 52 and the time period during which the leading edge 59 opens the fuel supply orifice 52. Such manner being typically known as a pressure-time control system which can be utilized for accurately metering specified quantities of metered fuel depending on engine operating conditions. Once the pressure within the upper metering chamber 95 reaches an increased level as the leading edge 59 pushes the fuel inwardly, the floating sleeve 80 is forced inwardly to open the seal formed between sealing surface 84 of floating sleeve 80 and the upper annular ledge 74 above second bore 72. Thus, fuel within the upper metering chamber 95 can then travel between the sealing surface 84 and upper annular ledge 74, between external surface 92 of floating sleeve 80 and the second bore 72, and through the passages defined by indents 90 along the profiled lower edge 88 of the floating sleeve 80. Moreover, the metering quantity of fuel passes between the lower outer surface of minor diameter section 62 and the inner surface of first bore 70 and into a lower metering chamber 97 formed at the tip of cup 16. This metered fuel is then injected when contacted by the plunger tip 29 and forced through injection orifices 25 into the engine cylinder of an internal combustion engine. Thereafter, the plunger tip 29 seats with seat 44 as the injector completes an injection cycle and returns to the position illustrated in FIG. 2.

During certain engine operating conditions, such as the motoring condition described above, little or no fuel is supplied to the upper metering chamber 95 during the engine operation as controlled by the pressure of the supplied fuel. The motoring condition occurs when the engine is driven from the vehicle drive train or under very light load. Thus, when the injector assumes the position illustrated in FIG. 4 under the influence of its associated drive train, little or no fuel is supplied to the upper metering chamber. At the same time that this is going on, the engine cylinder is experiencing a compression stroke, wherein the pressure of gases within the engine cylinder is greatly increased. This increased pressure forces gases through the injection orifices 25 and into the lower metering chamber 97 near the injector tip. The purpose of the present invention is to effectively restrict or eliminate the flow of these hot cylinder gases so that they cannot pass any further within the injector. To do this, the floating sleeve 80 is forced upwardly by the gas pressure within the lower metering chamber 97 which holds sealing surface 84 against the upper annular ledge 74 to seal the upper metering chamber 95 from the lower metering chanber 97. This seal between chambers 95 and 97 is further facilitated by the engagement between the minor diameter section 62 and the inner surface 82 of the floating sleeve 80. Moreover, the greater that the gas pressure within the lower metering chamber 97 becomes, the greater is the holding force of the floating sleeve 80 acting on the upper annular ledge 74. Then, as the plunger 28 is advanced to the FIG. 5 position and eventually the FIG. 2 position, the gases accumulated within the lower metering chamber 97 are expelled through injection orifices 25.

The floating sleeve 80 also further advantageously rides along the outer surface of the minor diameter section 62 as the lower plunger 28 is moved from the FIG. 4 to the FIG. 2 position in such a way that the upper edge of the interior surface 82 of the floating sleeve 80 scrapes any carbon deposits which may accumulate on the minor diameter section 62. In a like sense, the lower edge of the interior surface 82 of floating sleeve 80 scrapes the minor diameter section 62 as the lower plunger 28 is moved from the FIG. 2 position to the FIG. 4 position. Thus, even though the present invention substantially reduces the formation of carbon on the minor diameter section 62 of the lower plunger 28, any carbon deposits which may accumulate thereon are advantageously scraped from the minor diameter section 62 to prolong usage of such a unit injector without requiring regular maintenance. Moreover, the floating sleeve 80 effectively reduces carbon deposits on the injector components above the floating sleeve by restricting those gases which have been found to be essential for carbon formation.

INDUSTRIAL APPLICABILITY

It is understood that the present invention has a wide range of applicability as an improvement to open nozzle fuel injectors of all types. As long as the open nozzle injector includes a minor diameter plunger section that extends within an injector cup, the modification of the present invention will reduce carbon formation on the injector components. Furthermore, the floating sleeve improves such typical open nozzle fuel injectors by adding a major advantage only previously reserved for closed nozzle unit fuel injectors in that the backflow of hot cylinder gases is restricted from contacting critical portions of the open nozzle injector. Furthermore, unit injectors formed in accordance with the present invention can be utilized in both large and small vehicles for increasing injector longevity and performance while reducing injector maintenance.

We claim:

1. A unit fuel injector for use in an internal combustion engine of the type having a drive train associated with each unit injector to synchronously control each unit injector, said unit injector comprising:

an injector body having an axial bore open from one end of the injector body that terminates within a cup provided at another end of the injector body and at least one injection orifice passing through a tip of said cup from said axial bore, a plunger assembly reciprocably movably disposed within said axial bore for movement between a retracted position and an advanced position said plunger assembly comprising a major diameter section that slidably engages said axial bore and a minor diameter section that extends within said cup, fuel supply means comprising a fuel supply orifice that opens into said axial bore and which is opened and closed by said major diameter section of said plunger assembly as it is moved between said retracted and advanced positions, and valve means for permitting fluid flow in one direction between said minor diameter section of said plunger assembly and said cup and for substantially restricting fluid flow in the direction opposite to said one direction.

2. The unit injector of claim 1, wherein said cup includes a first coaxial bore portion of a diameter less than said axial bore within said injector body and a second coaxial bore portion of a diameter greater than said axial bore within said injector body, said first and second coaxial bore portions together forming an undercut means that limits axial movement of said valve means.

3. The unit injector of claim 2, wherein said valve means comprises a floating sleeve slidably disposed around said minor diameter section of said plunger assembly with no significant gap therebetween and within said undercut means, said floating sleeve having an axial dimension less than that of said second coaxial bore portion and an outside diameter less than that of said second coaxial bore portion, thereby permitting axial movement of said floating sleeve and providing a radial gap through which fluid can flow.

4. The unit injector of claim 3, wherein said floating sleeve further includes a seat means at an upper end thereof for engaging and sealing with an upper limit of said undercut means when said floating sleeve is located in an uppermost position so as to substantially restrict fluid passage between said axial bore of said injector body and said tip of said cup.

5. The unit injector of claim 4, wherein said floating sleeve further includes a spacer means at a lower edge thereof for abutting a lower limit of said undercut means and at the same time for providing a fluid flow passage therebetween when said floating sleeve is located in a lowermost position.

6. The unit injector of claim 2, wherein said cup is separable from said injector body and is attached thereto by a retaining means, said second coaxial bore portion is open to the end of said cup opposite to said tip; and said undercut means comprises said second coaxial bore portion as limited by an upper annular ledge formed by a lower surface of said injector body radially adjacent said axial bore thereof and a lower annular ledge connecting said first coaxial bore portion to said second coaxial bore portion.

7. The unit injector of claim 6, wherein said valve means comprises a floating sleeve slidably disposed around said minor diameter section of said plunger assembly with no significant gap therebetween and between said upper and lower annular ledges of said undercut means, said floating sleeve having an axial dimension less than that of said second coaxial bore portion and an outside diameter less than that of said second coaxial bore portion, thereby permitting axial movement of said floating sleeve and providing a radial gap through which fluid can flow.

8. The unit injector of claim 7, wherein said floating sleeve further includes a seat means at an upper end thereof for engaging and sealing with said upper annular ledge of said undercut means when said floating sleeve is located in an uppermost position so as to substantially restrict fluid passage between said axial bore of said injector body and said tip of said cup.

9. The unit injector of claim 8, wherein said floating sleeve further includes a spacer means at a lower edge thereof for abutting said lower annular ledge of said undercut means and at the same time for providing a fluid flow passage therebetween when said floating sleeve is located in a lowermost position.

10. A unit fuel injector for use in an internal combustion engine of the type having a drive train associated with each unit injector to synchronously control each unit injector, said unit injector comprising:

an injector body having an axial bore open from one end of the injector body that terminates within a cup provided at another end of the injector body and at least one injection orifice crossing through a tip of said cup from said axial bore, a plunger assembly reciprocably movably disposed within said axial bore for movement between a retracted position and an advanced position, said plunger assembly comprising a major diameter section that slidably engages said axial bore and a minor diameter section that extends within said cup, fuel supply means comprising a fuel supply orifice that opens into said axial bore and which is opened and closed by said major diameter section of said plunger assembly as it is moved between said retracted and advanced positions, and valve means positioned between said minor diameter section of said plunger assembly and a portion of said axial bore within said cup for permitting fluid flow from said fuel supply orifice to said tip of said cup, but which substantially restricts fluid flow from said tip past said minor diameter section of said plunger assembly.

11. The unit injector of claim 10, wherein said cup includes a first coaxial bore portion of a diameter less than said axial bore within said injector body and a second coaxial bore portion of a diameter greater than said axial bore within said injector body, said first and second coaxial bore portions together forming an undercut means that limits axial movement of said valve means.

12. The unit injector of claim 11, wherein said valve means comprises a floating sleeve slidably disposed around said minor diameter section of said plunger assembly with no significant gap therebetween and within said undercut means, said floating sleeve having an axial dimension less than that of said second coaxial bore portion and an outside diameter less than that of said second coaxial bore portion, thereby permitting axial movement of said floating sleeve and providing a radial gap through which fluid can flow.

13. The unit injector of claim 12, wherein said floating sleeve further includes a seal means at an upper end thereof for engaging and sealing with an upper limit of said undercut means when said floating sleeve is located in an uppermost position so as to substantially restrict fluid passage between said axial bore of said injector body and said tip cf said cup.

14. The unit injector of claim 13, wherein said floating sleeve further includes a spacer means at a lower edge thereof for abutting a lower limit of said undercut means and at the same time for providing a fluid flow passage therebetween when said floating sleeve is located in a lowermost position.

15. The unit injector of claim 11, wherein said cup is separable from said injector body and is attached thereto by a retaining means, said second coaxial bore portion is open to the end of said cup opposite to said tip, and said undercut means comprises said second coaxial bore portion as limited by an upper annular ledge formed by a lower surface of said injector body radially adjacent said axial bore thereof and a lower annular ledge connecting said first coaxial bore portion to said second coaxial bore portion.

16. The unit injector of claim 15, wherein said value means comprises a floating sleeve slidably disposed around said minor diameter section of said plunger assembly with no significant gap therebetween and between said upper and lower annular ledges of said undercut means, said floating sleeve having an axial dimension less than that of said second coaxial bore portion and an outside diameter less than that of said second coaxial bore portion, thereby permitting axial movement of said floating sleeve and providing a radial gap through which fluid can flow.

17. The unit injector of claim 16, wherein said floating sleeve further includes a seat means at an upper end thereof for engaging and sealing with said upper annular ledge of said undercut means when said floating sleeve is located in an uppermost position so as to substantially restrict fluid passage between said axial bore of said injector body and said tip of said cup.

18. The unit injector of claim 17, wherein said floating sleeve further includes a spacer means at a lower edge thereof for abutting said lower annular ledge of said undercut means and at the same time for providing a fluid flow passage therebetween when said floating sleeve is located in a lowermost position.

19. A unit fuel injector for use in an internal combustion engine of the type having a drive train associated with each unit injector to synchronously control each unit injector, said unit injector comprising:

an injector body having an axial bore open from one end of the injector body that terminates within a cup provided at another end of the injector body and at least one injection orifice passing through a tip of said cup from said axial bore, a plunger assembly reciprocably movably disposed within said axial bore for movement between a retracted position and an advanced position, said plunger assembly comprising a major diameter section that slidably engages said axial bore and a minor diameter section that extends within said cup, fuel supply means comprising a fuel supply orifice that opens into said axial bore and which is opened and closed by said major diameter section of said plunger assembly as it is moved between said retracted and advanced positions, valve means for permitting fluid flow in one direction between said minor diameter section of said plunger assembly and said cup and for substantially restricting fluid flow in the direction opposite to said one direction, and undercut means for allowing a limited axial movement of said valve means relative to said cup so that when said valve means assumes a first position a seal is formed between said axial bore of said injector body and said cup, and when said valve means assumes a second position fluid can pass from said axial bore of said injector body to said cup.

20. The unit injector of claim 19, wherein said valve means comprises a floating sleeve slidably disposed around said minor diameter section of said plunger assembly with no significant gap therebetween and within said undercut means, said floating sleeve having an axial dimension less than that of said second coaxial bore portion and an outside diameter less than that of said second coaxial bore portion, thereby permitting said limited axial movement of said floating sleeve and providing a radial gap through which fluid can flow, said floating sleeve including a seat means at an upper end thereof for engaging and sealing with an upper limit of said undercut means when said floating sleeve is located in an uppermost position so as to substantially restrict fluid passage between said axial bore of said injector body and said tip of said cup, and a spacer means at a lower edge thereof for abutting a lower limit of said undercut means and at the same time for providing a fluid flow passage therebetween when said floating sleeve is located in an lowermost position.

* * * * *